US007884292B2

(12) United States Patent
Zhang et al.

(10) Patent No.: US 7,884,292 B2
(45) Date of Patent: Feb. 8, 2011

(54) ELECTRICAL SAFETY RECEPTACLE WITH A CROSS-CONNECTION CIRCUIT

(75) Inventors: Yulin Zhang, Yueqing (CN); Chunhua Cheng, Yueqing (CN); Sunmin Lu, Yueqing (CN)

(73) Assignee: General Protecht Group, Inc., Yueqing (CN)

( * ) Notice: Subject to any disclaimer, the term of this patent is extended or adjusted under 35 U.S.C. 154(b) by 0 days.

(21) Appl. No.: 12/711,320

(22) Filed: Feb. 24, 2010

(65) Prior Publication Data

US 2010/0216326 A1 Aug. 26, 2010

(30) Foreign Application Priority Data

Feb. 25, 2009 (CN) ..... 2009 1 0117812

(51) Int. Cl.
*H01R 24/00* (2006.01)

(52) U.S. Cl. ..... 200/51.02; 439/188

(58) Field of Classification Search ..... 200/51.02, 200/51.09, 51.12, 51.1, 51.11; 439/188, 439/139, 143, 346, 259, 261, 692, 693–694
See application file for complete search history.

(56) References Cited

U.S. PATENT DOCUMENTS

| | | | | |
|---|---|---|---|---|
| 7,070,432 | B1 * | 7/2006 | Lin | 439/188 |
| 7,575,467 | B2 * | 8/2009 | Ferguson et al. | 439/489 |
| 2002/0104745 | A1 * | 8/2002 | Allison | 200/51.09 |

* cited by examiner

*Primary Examiner*—Edwin A. Leon
(74) *Attorney, Agent, or Firm*—Tim Tingkang Xia; Morris, Manning & Martin, LLP

(57) ABSTRACT

An electrical safety receptacle with a cross-connection circuit, comprising: a line, a neutral and a ground wire input from an electrical power source, a line, a neutral and a ground wire output receptacles, four sets of fixed connection points, four sets of movable connection points, a first and a second cross-connection metal connectors, receptacle housing, a top cover, and a plurality of installation screws, when a line prong and a neutral prong of a power plug are not inserted into the line and neutral wire output receptacles, the line and neutral wire output receptacles are not electrically connected to the line wire and neutral wire of the electrical power source, and when the line prong and the neutral prong of the power plug are inserted into the line and neutral wire output receptacles, the line and neutral wire output receptacles are electrically connected to the line wire and neutral wire of the electrical power source.

11 Claims, 3 Drawing Sheets

(A)

(B)

ELECTRICAL SAFETY RECEPTACLE WITH A CROSS-CONNECTION CIRCUIT

CROSS-REFERENCE TO RELATED APPLICATION

This application claims priority of Chinese Patent Application No. 200910117812.3, filed on Feb. 25, 2009, entitled "Electrical Safety Receptacle with A Cross-Connection Circuit" by Yulin Zhang, Chunhua Cheng, and Sunmin Lü, the disclosure of which is incorporated herein by reference in its entirety.

FIELD OF THE PRESENT INVENTION

The present invention generally relates to electrical safety receptacle. More particularly, the present invention relates to an electrical safety receptacle with a cross-connection circuit.

BACKGROUND OF THE PRESENT INVENTION

Electrical receptacles for various appliances are commonly used in everyday life. As the awareness of product safety and demands for higher performance and safer appliances, electrical/electronic products, manufacturer of various appliances, power suppliers, power connectors, and wall outlets are looking for new ways to improve the safety of these products. Electrical safety sockets are generally divided into two categories: the first one has two plugholes connected to two wires (one is for hot wire, and the other is for neutral wire), and the second one has three plugholes connected to three wires (the first one is for hot wire, the second one is for neutral wire and the third one is for ground). They are designed to be used with the two prong plugs or three prong plugs generally available on the market. Current products are usually connected to electrical sources all the time, and they provide electricity as soon as they are plugged in. The continuous connection to the electrical sources may be hazardous to little children. For example, young children may not be aware of the fact that the two wires in the receptacle are not to be connected by an electricity conductive material, such as metal wire. These children may attempt to put metal materials into the two plugholes out of curiosity. These actions may cause fire, injury to human, and/or damage to property. The difficulty of preventing the accidents from happening has not been overcome for a long time.

The electrical receptacles currently available on the market share certain common deficiencies: (1) protection against hot and neutral wires being accidentally short circuited and (2) providing electricity only when matching electrical plugs are used.

Therefore, a heretofore unaddressed need exists in the art to address the aforementioned deficiencies and inadequacies.

SUMMARY OF THE PRESENT INVENTION

In one aspect, the present invention relates to an electrical safety receptacle with a cross-connection circuit. In one embodiment, the electrical safety receptacle with a cross-connection circuit has: (i) a line wire input, (ii) a neutral wire input, (iii) a line wire output receptacle, (iv) a neutral wire output receptacle, (v) a first fixed connection point, (vi) a second fixed connection point, (vii) a third fixed connection point, (viii) a fourth fixed connection point, (ix) a first movable connection assembly having a first movable connection point, (x) a second movable connection assembly having a second movable connection point, (xi) a third movable connection assembly having a third movable connection point, and (xii) a fourth movable connection assembly having a fourth movable connection point. In one embodiment, the line wire input and the neutral wire input are electrically connected to a line wire and a neutral wire of an electrical power source, respectively. The line wire output receptacle and the neutral wire output receptacle are used to provide a line wire and a neutral wire to an electrical appliance.

In one embodiment, the first fixed connection point is electrically connected to the line wire output receptacle, and the second fixed connection point is electrically connected to the neutral wire output receptacle. The third fixed connection point is electrically connected to the line wire input, and the fourth fixed connection point is electrically connected to the neutral wire input.

In one embodiment, the electrical safety receptacle with a cross-connection circuit further includes a first cross-connection metal connector electrically connecting the first movable connection point to the third movable connection point, and a second cross-connection metal connector electrically connecting the second movable connection point to the fourth movable connection point.

In one embodiment, the electrical safety receptacle with a cross-connection circuit further includes: (i) a receptacle housing having a first, a second, a third, and a fourth movable connection point chambers, to install the first, the second, the third, and fourth movable connection points, and a plurality of notches, (ii) a top cover having three openings: one for the neutral wire, one for the line wire and one for the ground, and a plurality of protrusion at the bottom to fit into the plurality of notches, (iii) a plurality of installation screws, (iv) a ground connector having a receptacle portion, (v) a line wire connector, which is electrically connected to the third fixed connection point, and (vi) a neutral wire connector, which is electrically connected to the fourth fixed connection point.

In one embodiment, the line wire output receptacle includes: (i) a first resilient moving part, and (ii) a second resilient moving part, wherein the first resilient moving part is used to electrically connect the first movable connection point to the first fixed connection point, and the second resilient moving part is used to electrically connect the fourth movable connection point to the fourth fixed connection point, when the line prong of the power plug is inserted into the line wire output receptacle.

In one embodiment, the neutral wire output receptacle includes: (i) a third resilient moving part, and (ii) a fourth resilient moving part, wherein the third resilient moving part is used to electrically connect the second movable connection point to the second fixed connection point, and the fourth resilient moving part is used to electrically connect the third movable connection point to the third fixed connection point, when the neutral prong of the power plug is inserted into the neutral wire output receptacle.

In one embodiment, the first movable connection assembly includes: (i) a first contacting lever, (ii) a first axel to allow the first contacting lever to move and to make connection, and (iii) a first reset springs, to disconnect the first movable connection point from the corresponding first fixed connection point, when the line prong of the power plug is removed from the line wire output receptacle. The first contact lever, the first axel, and the first reset spring are assembled into the first movable connection point chamber.

In one embodiment, the second movable connection assembly includes: (i) a second contacting lever, (ii) a second axel to allow the second contacting lever to move and to make connection, and (iii) a second reset spring, to disconnect the second movable connection point from the corresponding second fixed connection point, when the neutral prong of the power plug is removed from the neutral wire output receptacle. The second contact lever, the second axel, and the second reset spring are assembled into the second movable connection point chamber.

In one embodiment, the third movable connection assembly includes: (i) a third contacting lever, (ii) a third axel to allow the third contacting lever to move and to make connection, and (iii) a third reset spring, to disconnect the third movable connection point from the corresponding third fixed connection point, when the neutral prong of the power plug is removed from the neutral wire output receptacle. The third contact lever, the third axel, and the third reset spring are assembled into the third movable connection point chamber, with the third axel extending to the fourth movable connection point chamber.

In one embodiment, the fourth movable connection assembly includes: (i) a fourth contacting lever, (ii) a fourth axel tube to allow the third axel to go through and such that the fourth contacting lever can move and make connection, and (iii) a fourth reset spring, to disconnect the fourth movable connection point from the corresponding fourth fixed connection point, when the line prong of the power plug is removed from the line wire output receptacle. The fourth contact lever and the fourth reset spring are assembled into the fourth movable connection point chamber, and the fourth axel tube is installed between the third and fourth movable connection point chambers.

When the line wire output receptacle is not inserted with a line prong of a power plug, the first movable connection point is not electrically connected to the first fixed connection point, and the fourth movable connection point is not electrically connected to the fourth fixed connection point, respectively. When the neutral wire output receptacle 02 is not inserted with a neutral prong of the power plug, the second movable connection point 041 is not electrically connected to the second fixed connection point, and the third movable connection point is not electrically connected to the third fixed connection point, respectively. The line wire output receptacle and the neutral wire output receptacle are, therefore, not electrically connected to the line wire and neutral wire of the electrical power source, respectively.

When the line wire output receptacle is inserted with the line prong of the power plug, the first movable connection point is electrically connected to the first fixed connection point, and the fourth movable connection point is electrically connected to the fourth fixed connection point, respectively. When the neutral wire output receptacle is inserted with the neutral prong of the power plug, the second movable connection point is electrically connected to the second fixed connection point, and the third movable connection point is electrically connected to the third fixed connection point, respectively. The line wire output receptacle and the neutral wire output receptacle are, therefore, electrically connected to the line wire and neutral wire of the electrical power source, respectively.

In one embodiment, the neutral prong and the line prong of the power plug are inserted simultaneously into the electrical safety receptacle with a cross-connection circuit.

The electrical safety receptacle with a cross-connection circuit provides electrical power to the electrical appliance only when the line prong and neutral prong of the power plug are inserted into the electrical safety receptacle with a cross-connection circuit, and the line wire output receptacle and the neutral wire output receptacle are not electrically connected to the line wire and the neutral wire of the electrical power source when the line prong and neutral prong of the power plug are not inserted into the electrical safety receptacle with a cross-connection circuit.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers, and wherein.

DETAILED DESCRIPTION OF THE PRESENT INVENTION

Figure 1:
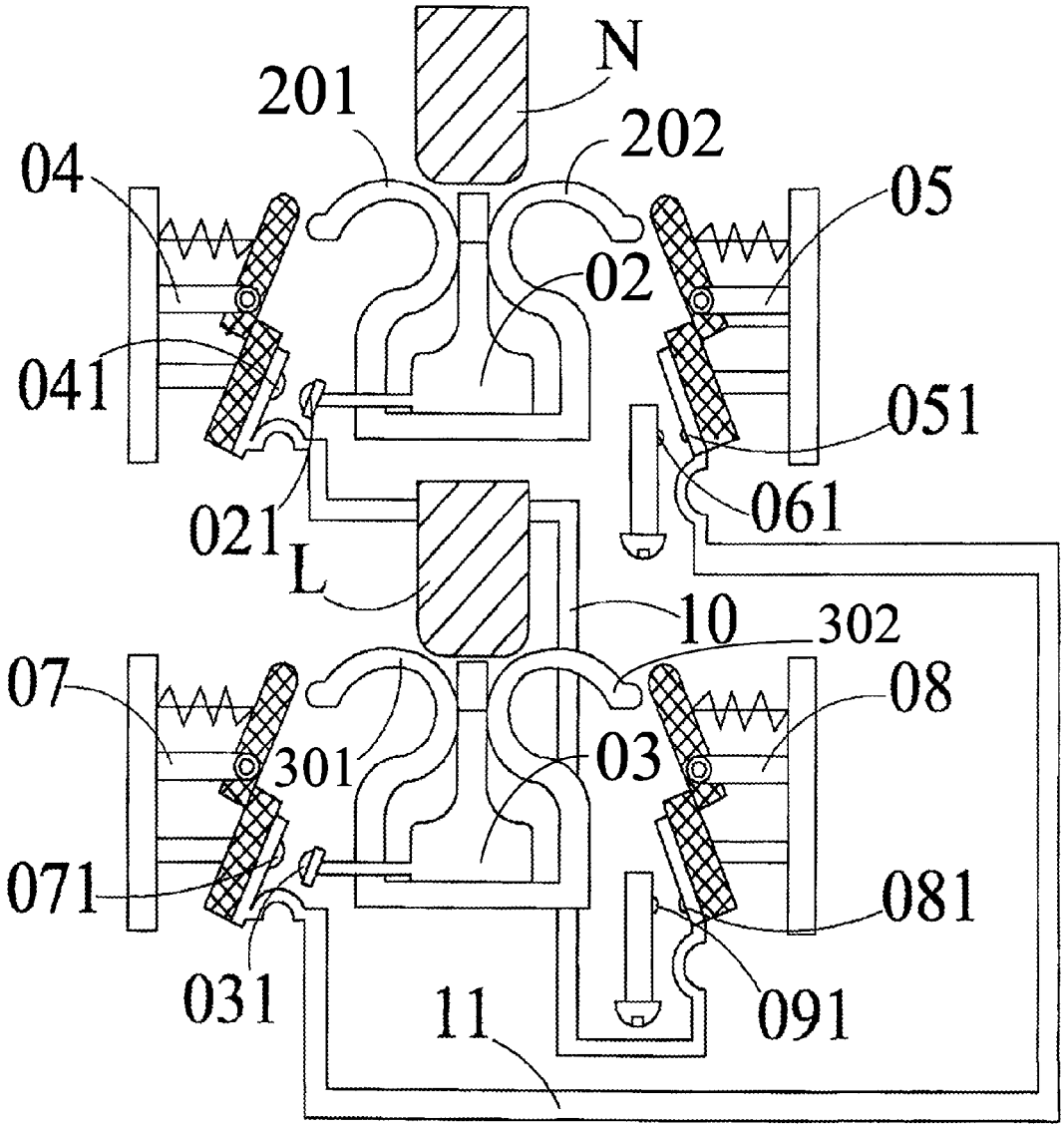
FIG. 1 shows an exemplary illustration of an electrical safety receptacle with cross-connection circuit according to one embodiment of the present invention.

The present disclosure is more particularly described in the following examples that are intended as illustrative only since numerous modifications and variations therein will be apparent to those skilled in the art. Various embodiments of the disclosure are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

Whether or not a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. A capitalized term within the glossary usually indicates that the capitalized term has a separate definition within the glossary. However, the capitalization or lack thereof within the remainder of this document is not intended to be necessarily limiting unless the context clearly indicates that such limitation is intended.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The terms "unit" and "circuit", as used herein, are interchangeable.

The description will be made as to the embodiments of the present invention in conjunction with the reference to the accompanying drawings in FIGS. 1-3. In accordance with the purposes of this invention, as embodied and broadly described herein, this invention, in one aspect, relates to an electrical safety receptacle with cross-connection circuit.

Mechanical Structure of the Electrical Safety Receptacle with Cross-Connection Circuit Referring now to FIG. 1, an exemplary illustration of an electrical safety receptacle with cross-connection circuit is shown according to one embodiment of the present invention. In one embodiment, the electrical safety receptacle with a cross-connection circuit has: (i) a line wire input 06, (ii) a neutral wire input 09, (iii) a line wire output receptacle 03, (iv) a neutral wire output receptacle 02, (v) a first fixed connection point 031, (vi) a second fixed connection point 021, (vii) a third fixed connection point 061, (viii) a fourth fixed connection point 091, (ix) a first movable connection assembly 07 having a first movable connection point 071, (x) a second movable connection assembly 04 having a second movable connection point 041, (xi) a third movable connection assembly 05 having a third movable connection point 051, and (xii) a fourth movable connection assembly 08 having a fourth movable connection point 081. In one embodiment, the line wire input 06 and the neutral wire input 09 are electrically connected to a line wire and a neutral wire of an electrical power source, respectively. The line wire output receptacle 03 and the neutral wire output receptacle 02 are used to provide a line wire and a neutral wire of an electrical appliance through a line wire plug L and a neutral wire plug N.

In one embodiment, the first fixed connection point 031 is electrically connected to the line wire output receptacle 03, and the second fixed connection point 021 is electrically connected to the neutral wire output receptacle 02. The third fixed connection point 061 is electrically connected to the line wire input 06, and the fourth fixed connection point 091 is electrically connected to the neutral wire input 09.

In one embodiment, the electrical safety receptacle with a cross-connection circuit further includes a first cross-connection metal connector 11 electrically connecting the first movable connection point 071 to the third movable connection point 051, and a second cross-connection metal connector 10 electrically connecting the second movable connection point 041 to the fourth movable connection point 081.

In one embodiment, the line wire output receptacle 03 includes: (i) a first resilient moving part 301, and (ii) a second resilient moving part 302, wherein the first resilient moving part 301 is used to electrically connect the first movable connection point 071 to the first fixed connection point 031, and the second resilient moving part 302 is used to electrically connect the fourth movable connection point 081 to the fourth fixed connection point 091, when the line prong of the power plug is inserted into the line wire output receptacle 03.

In one embodiment, the neutral wire output receptacle 02 includes: (i) a third resilient moving part 201, and (ii) a fourth resilient moving part 202, wherein the third resilient moving part 201 is used to electrically connect the second movable connection point 041 to the second fixed connection point 021, and the fourth resilient moving part 202 is used to electrically connect the third movable connection point 051 to the third fixed connection point 061, when the neutral prong of the power plug is inserted into the neutral wire output receptacle 02.

Figure 2:
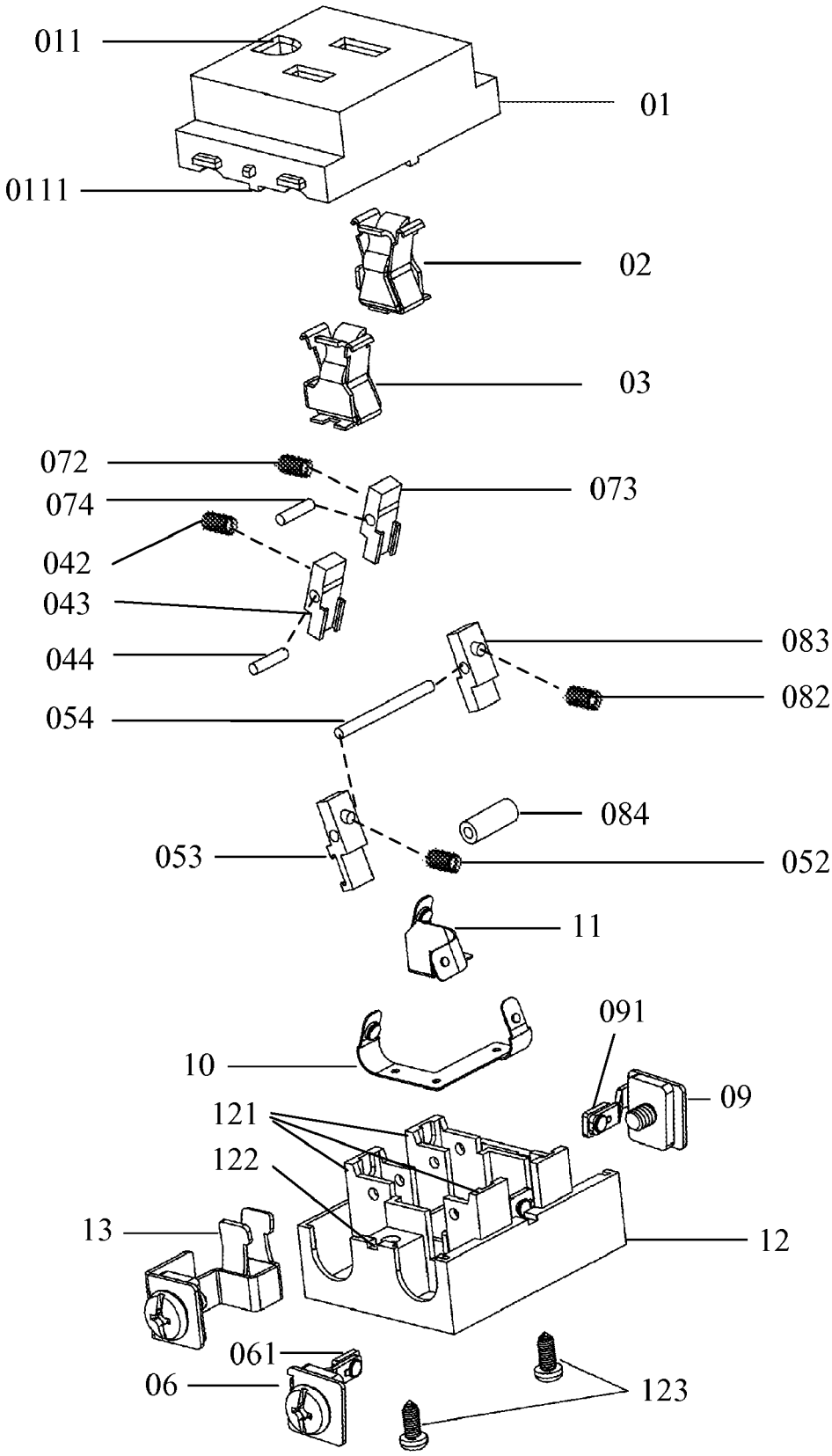
FIG. 2 shows an exploded view of an electrical safety receptacle with cross-connection circuit according to one embodiment of the present invention.
Figure 3:
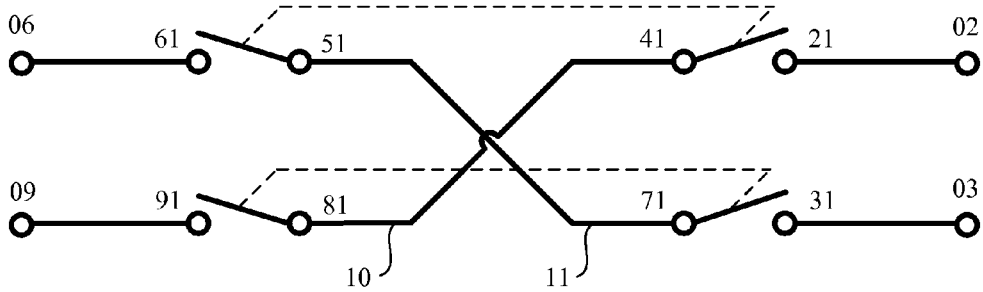
FIG. 3A illustrates an equivalent electrical circuit when the neutral wire and line wire receptacles are not physically plugged in according to one embodiment of the present invention.
FIG. 3B illustrates an equivalent electrical circuit when the neutral and line wire receptacles are physically plugged in according to one embodiment of the present invention.
Figure 3:
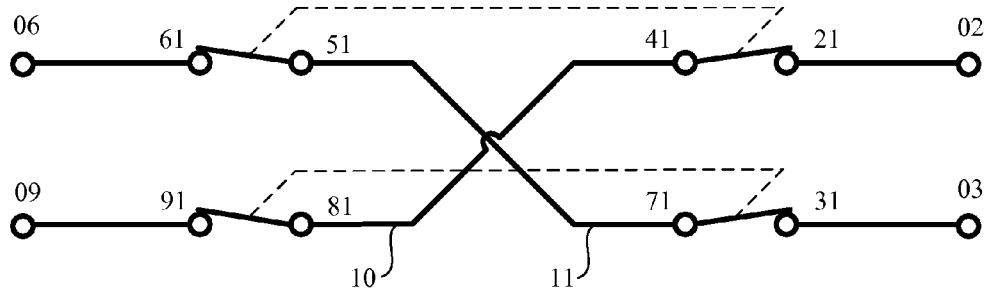

Referring now to FIG. 2, an exploded view of an electrical safety receptacle with cross-connection circuit is shown according to one embodiment of the present invention. In one embodiment, the electrical safety receptacle with a cross-connection circuit further includes: (i) a receptacle housing 12 having a first, a second, a third, and a fourth movable connection point chambers 121, to install the first, the second, the third, and fourth movable connection points 071, 041, 051, and 081, and a plurality of notches 122, (ii) a top cover 01 having three openings: one for the neutral wire, one for the line wire and one for the ground 011, and a plurality of protrusion 0111 at the bottom to fit into the plurality of notches 122, (iii) a plurality of installation screws 123, (iv) a ground connector 13 having a receptacle portion, (v) a line wire connector 06, which is electrically connected to the third fixed connection point 061, and (vi) a neutral wire connector 09, which is electrically connected to the fourth fixed connection point 091.

In one embodiment, the electrical safety receptacle with a cross-connection circuit further includes a first cross-connection metal connector 11 electrically connecting the first movable connection point 071 to the third movable connection point 051, and a second cross-connection metal connector 10 electrically connecting the second movable connection point 041 to the fourth movable connection point 081.

In one embodiment, the first movable connection assembly 07 includes: (i) a first contacting lever 073, (ii) a first axel 074 to allow the first contacting lever 073 to move and to make connection, and (iii) a first reset springs 072, to disconnect the first movable connection point 071 from the corresponding first fixed connection point 031, when the line prong of the power plug is removed from the line wire output receptacle 03. The first contact lever 073, the first axel 074, and the first reset spring 072 are assembled into the first movable connection point chamber 121.

In one embodiment, the second movable connection assembly 04 includes: (i) a second contacting lever 043, (ii) a second axel 044 to allow the second contacting lever 043 to move and to make connection, and (iii) a second reset spring 042, to disconnect the second movable connection point 041 from the corresponding second fixed connection point 021, when the neutral prong of the power plug is removed from the neutral wire output receptacle 02. The second contact lever 043, the second axel 044, and the second reset spring 042 are assembled into the second movable connection point chamber 121.

In one embodiment, the third movable connection assembly 05 includes: (i) a third contacting lever 053, (ii) a third axel 054 to allow the third contacting lever 053 to move and to make connection, and (iii) a third reset spring 052, to disconnect the third movable connection point 051 from the corresponding third fixed connection point 061, when the neutral prong of the power plug is removed from the neutral wire output receptacle 02. The third contact lever 053, the third axel 054, and the third reset spring 052 are assembled into the third movable connection point chamber 121, with the third axel extending to the fourth movable connection point chamber.

In one embodiment, the fourth movable connection assembly 08 includes: (i) a fourth contacting lever 083, (ii) a fourth axel tube 084 to allow the third axel 054 to go through and such that the fourth contacting lever 083 can move and make connection, and (iii) a fourth reset spring 082, to disconnect the fourth movable connection point 081 from the corresponding fourth fixed connection point 091, when the line prong of the power plug is removed from the line wire output receptacle 03. The fourth contact lever 083 and the fourth reset spring 082 are assembled into the fourth movable connection point chamber 121, and the fourth axel tube 084 is installed between the third and fourth movable connection point chambers 121.

Electrical Structure of the Electrical Safety Receptacle with Cross-Connection Circuit Referring now to FIGS. 3A and 3B, an equivalent electrical circuit when the neutral wire and line wire receptacles are not physically plugged in is illustrated FIG. 3A, an equivalent electrical circuit when the neutral and line wire receptacles are physically plugged in is illustrated in FIG. 3B according to one embodiment of the present invention.

When the line wire output receptacle 03 is not inserted with a line prong of a power plug, as shown in FIG. 3A, the first movable connection point 071 is not electrically connected to the first fixed connection point 031, and the fourth movable connection point 081 is not electrically connected to the fourth fixed connection point 091, respectively. When the neutral wire output receptacle 02 is not inserted with a neutral prong of the power plug, the second movable connection point 041 is not electrically connected to the second fixed connection point 021, and the third movable connection point 051 is not electrically connected to the third fixed connection point 061, respectively. The line wire output receptacle 03, and the neutral wire output receptacle 02 are, therefore, not electrically connected to the line wire and neutral wire of the electrical power source, respectively.

When the line wire output receptacle 03 is inserted with the line prong of the power plug, as shown in FIG. 3B, the first movable connection point 071 is electrically connected to the first fixed connection point 031, and the fourth movable connection point 081 is electrically connected to the fourth fixed connection point 091, respectively. When the neutral wire output receptacle 02 is inserted with the neutral prong of the power plug, the second movable connection point 041 is electrically connected to the second fixed connection point 021, and the third movable connection point 051 is electrically connected to the third fixed connection point 061, respectively. The line wire output receptacle 03, and the neutral wire output receptacle 02 are, therefore, electrically connected to the line wire and neutral wire of the electrical power source, respectively.

In one embodiment, the neutral prong and the line prong of the power plug are inserted simultaneously into the electrical safety receptacle with a cross-connection circuit.

The electrical safety receptacle with a cross-connection circuit provides electrical power to the electrical appliance only when the line prong and neutral prong of the power plug are inserted into the electrical safety receptacle with a cross-connection circuit, and the line wire output receptacle 03 and the neutral wire output receptacle 02 are not electrically connected to the line wire and the neutral wire of the electrical power source when the line prong and neutral prong of the power plug are not inserted into the electrical safety receptacle with a cross-connection circuit.

While there has been shown several and alternate embodiments of the present invention, it is to be understood that certain changes can be made as would be known to one skilled in the art without departing from the underlying scope of the present invention as is discussed and set forth above and below including claims. Furthermore, the embodiments described above and claims set forth below are only intended to illustrate the principles of the present invention and are not intended to limit the scope of the present invention to the disclosed elements.

What is claimed is:

1. An electrical safety receptacle with a cross-connection circuit, comprising:

(i) a line wire input, wherein the line wire input is electrically connected to a line wire of an electrical power source;

(ii) a neutral wire input, wherein the neutral wire input is electrically connected to a neutral wire of the electrical power source;

(iii) a line wire output receptacle, wherein the line wire output receptacle is electrically connected to a line wire of an electrical appliance;

(iv) a neutral wire output receptacle, wherein the neutral wire output receptacle is electrically connected to a neutral wire of the electrical appliance;

(v) a first fixed connection point, wherein the first fixed connection point is electrically connected to the line wire output receptacle;

(vi) a second fixed connection point, wherein the second fixed connection point is electrically connected to the neutral wire output receptacle;

(vii) a third fixed connection point, wherein the third fixed connection point is electrically connected to the line wire input;

(viii) a fourth fixed connection point, wherein the fourth fixed connection point is electrically connected to the neutral wire input;

(ix) a first movable connection assembly having a first movable connection point;

(x) a second movable connection assembly having a second movable connection point;

(xi) a third movable connection assembly having a third movable connection point; and (xii) a fourth movable connection assembly having a fourth movable connection point, wherein, when the line wire output receptacle is not inserted with a line prong of a power plug, the first movable connection point is not electrically connected to the first fixed connection point, and the fourth movable connection point is not electrically connected to the fourth fixed connection point, respectively, and when the neutral wire output receptacle is not inserted with a neutral prong of the power plug, the second movable connection point is not electrically connected to the second fixed connection point, and the third movable connection point is not electrically connected to the third fixed connection point, respectively, and the line wire output receptacle, and the neutral wire output receptacle are not electrically connected to the line wire and neutral wire of the electrical power source, respectively, and wherein, when the line wire output receptacle is inserted with the line prong of the power plug, the first movable connection point is electrically connected to the first fixed connection point, and the fourth movable connection point is electrically connected to the fourth fixed connection point, respectively, and when the neutral wire output receptacle is inserted with the neutral prong of the power plug, the second movable connection point is electrically connected to the second fixed connection point, and the third movable connection point is electrically connected to the third fixed connection point, respectively, and the line wire output receptacle, and the neutral wire output receptacle are electrically connected to the line wire and neutral wire of the electrical power source, respectively.

2. The electrical safety receptacle with a cross-connection circuit of claim 1, wherein the electrical safety receptacle with a cross-connection circuit further comprises:

(i) a first cross-connection metal connector electrically connecting the first movable connection point to the third movable connection point; and (ii) a second cross-connection metal connector electrically connecting the second movable connection point to the fourth movable connection point.

3. The electrical safety receptacle with a cross-connection circuit of claim 2, wherein the electrical safety receptacle with a cross-connection circuit further comprises:

(i) a receptacle housing having a first, a second, a third, and a fourth movable connection point chambers, to install the first, the second, the third, and fourth movable connection points, and a plurality of notches;

(ii) a top cover having three openings: one for the neutral wire, one for the line wire and one for the ground, and a plurality of protrusion at the bottom to fit into the plurality of notches;

(iii) a plurality of installation screws;

(iv) a ground connector having a receptacle portion;

(v) a line wire connector, which is electrically connected to the third fixed connection point; and (vi) a neutral wire connector, which is electrically connected to the fourth fixed connection point.

4. The electrical safety receptacle with a cross-connection circuit of claim 3, wherein the line wire output receptacle comprises:

(i) a first resilient moving part; and (ii) a second resilient moving part, wherein the first resilient moving part is used to electrically connect the first movable connection point to the first fixed connection point, and the second resilient moving part is used to electrically connect the fourth movable connection point to the fourth fixed connection point, when the line prong of the power plug is inserted into the line wire output receptacle.

5. The electrical safety receptacle with a cross-connection circuit of claim 4, wherein the neutral wire output receptacle comprises:

(i) a third resilient moving part; and (ii) a fourth resilient moving part, wherein the third resilient moving part is used to electrically connect the second movable connection point to the second fixed connection point, and the fourth resilient moving part is used to electrically connect the third movable connection point to the third fixed connection point, when the neutral prong of the power plug is inserted into the neutral wire output receptacle.

6. The electrical safety receptacle with a cross-connection circuit of claim 5, wherein the first movable connection assembly comprises:

(i) a first contacting lever;

(ii) a first axel to allow the first contacting lever to move and to make connection; and (iii) a first reset springs, to disconnect the first movable connection point from the corresponding first fixed connection point, when the line prong of the power plug is removed from the line wire output receptacle, wherein the first contact lever, the first axel, and the first reset spring are assembled into the first movable connection point chamber.

7. The electrical safety receptacle with a cross-connection circuit of claim 6, wherein the second movable connection assembly comprises:

(i) a second contacting lever;

(ii) a second axel to allow the second contacting lever to move and to make connection; and (iii) a second reset spring, to disconnect the second movable connection point from the corresponding second fixed connection point, when the neutral prong of the power plug is removed from the neutral wire output receptacle, wherein the second contact lever, the second axel, and the second reset spring are assembled into the second movable connection point chamber.

8. The electrical safety receptacle with a cross-connection circuit of claim 7, wherein the third movable connection assembly comprises:

(i) a third contacting lever;

(ii) a third axel to allow the third contacting lever to move and to make connection; and (iii) a third reset spring, to disconnect the third movable connection point from the corresponding third fixed connection point, when the neutral prong of the power plug is removed from the neutral wire output receptacle, wherein the third contact lever, the third axel, and the third reset spring are assembled into the third movable connection point chamber, with the third axel extending to the fourth movable connection point chamber.

9. The electrical safety receptacle with a cross-connection circuit of claim 8, wherein the fourth movable connection assembly comprises:

(i) a fourth contacting lever;

(ii) a fourth axel tube to allow the third axel to go through and such that the fourth contacting lever can move and make connection; and (iii) a fourth reset spring, to disconnect the fourth movable connection point from the corresponding fourth fixed connection point, when the line prong of the power plug is removed from the line wire output receptacle, wherein the fourth contact lever and the fourth reset spring are assembled into the fourth movable connection point chamber, and the fourth axel tube is installed between the third and fourth movable connection point chambers.

10. The electrical safety receptacle with a cross-connection circuit of claim 9, wherein the neutral prong and the line prong of the power plug are inserted simultaneously into the electrical safety receptacle with a cross-connection circuit.

11. The electrical safety receptacle with a cross-connection circuit of claim 10, wherein the electrical safety receptacle with a cross-connection circuit provides electrical power to the electrical appliance only when the line prong and neutral prong of the power plug are inserted into the electrical safety receptacle with a cross-connection circuit, and the line wire output receptacle and the neutral wire output receptacle are not electrically connected to the line wire and the neutral wire of the electrical power source when the line prong and neutral prong of the power plug are not inserted into the electrical safety receptacle with a cross-connection circuit.

* * * * *